US005868061A

United States Patent [19]

Hansen et al.

[11] Patent Number: 5,868,061

[45] Date of Patent: Feb. 9, 1999

[54] HYDRAULIC AXIAL PISTON MACHINE

[75] Inventors: Ove Thorbøl Hansen, Nordborg; Lars Martensen, Sønderborg, both of Denmark

[73] Assignee: Danfoss A/S, Nordborg, Denmark

[21] Appl. No.: 696,978

[22] PCT Filed: Feb. 17, 1995

[86] PCT No.: PCT/DK95/00068

§ 371 Date: Oct. 7, 1996

§ 102(e) Date: Oct. 7, 1996

[87] PCT Pub. No.: WO95/23289

PCT Pub. Date: Aug. 31, 1995

[30] Foreign Application Priority Data

Feb. 17, 1994 [DE] Germany ..... 4405967.1

[51] Int. Cl.[6] ..... F01B 3/00

[52] U.S. Cl. ..... 92/71; 74/60; 91/499

[58] Field of Search ..... 92/12.2, 71, 57; 74/60; 417/269; 91/499

[56] References Cited

U.S. PATENT DOCUMENTS 3,641,829 2/1972 Reynolds ..... 74/60

3,861,276 1/1975 Lucien ..... 91/499

3,996,841 12/1976 Gostomski, Jr. ..... 74/60

4,014,628 3/1977 Ruseff et al. ..... 91/499

4,252,051 2/1981 Sato et al. ..... 91/499

4,620,475 11/1986 Watts ..... 92/57

5,046,403 9/1991 Riedhammer ..... 92/57

5,520,088 5/1996 Dixen ..... 92/71

*Primary Examiner*—Thomas E. Denion

*Attorney, Agent, or Firm*—Lee, Mann, Smith, McWilliams, Sweeney & Ohlson

[57] ABSTRACT

A hydraulic axial piston machine is described, having axially movable pistons, which at one end bear by means of slider shoes against a slanting plate, and having a pressure plate (10) for holding the slider shoes in contact with the slanting plate. Under certain operating conditions the slider shoes have a tendency to tilt and lift away from the slanting plate at one side. To prevent this, the pressure plate (10) acts only on a part lying, in the radial direction of the slanting plate (7), outside a predetermined region (28).

12 Claims, 2 Drawing Sheets

HYDRAULIC AXIAL PISTON MACHINE

Figure 1:
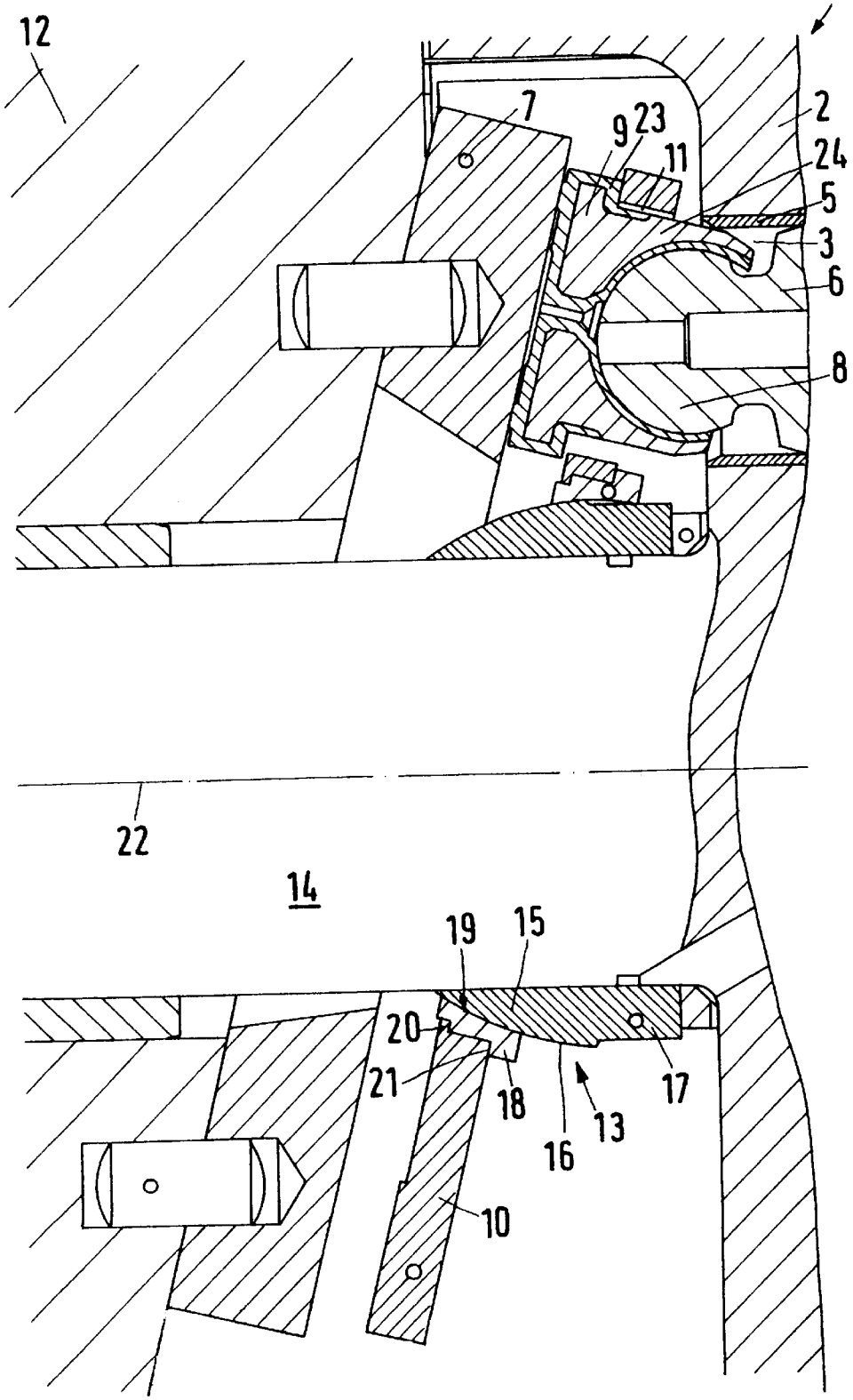

The invention relates to a hydraulic axial piston machine having axially movable pistons, which at one end bear by means of slider shoes against a slanting plate, and having a pressure plate for holding the slider shoes in contact with the slanting plate.

The pressure plate holds the slider shoes in engagement with the slanting plate. Here, it is desirable for the alignment of the slider shoe running face with the slanting plate to be as parallel as possible, so that wear and tear on the slider shoes is not lop-sided and at the same time hydraulic deloading can be effected by fluid fed in between the slider shoe running face and the slanting plate.

The problem involved here, however, is that in operation the pressure plate and the slider shoes are exposed to considerable forces, which in many cases try to lift the slider shoe running face away from the slanting plate. These forces include, inter alia the centrifugal force acting on the slider shoes and the acceleration force caused by the acceleration of the piston, as well as forces caused in pump operation by suction pressures. The contact force exerted by the pressure plate has to act against these forces. In many cases this force originates in the centre of the pressure plate, for example, through a ball-and-socket joint. Since the pressure plate is not infinitely rigid, the above-mentioned forces subject it to a distortion, so that the pressure plate becomes slightly concave, that is to say, the distance to the slanting plate from its middle is smaller than from its radially outer edge. This in turn leads to the point of engagement between slider shoe and pressure plate being shifted inwards, that is, towards the midpoint of the pressure plate. Combined with the above-mentioned forces acting on the slider shoes, this shift in the point of engagement results in the slider shoes tilting and lifting away at one side from the slanting plate. In that case, on the one hand the wear and tear on the slider shoes is undesirably lop-sided, as mentioned above, and on the other hand the pressure relief acting on the slider shoes no longer functions, so that additional wear occurs there.

The problem is known per se. In DE 37 25 979 C2, an attempt to overcome this problem is made by using a slanting plate of a smaller diameter, so that the slider shoe running face projects radially outwards a little way beyond the slanting plate.

U.S. Pat. No. 3,382,814 discloses a different axial piston machine, in which the pressure plate is in the form of a spring, which is biassed so that a predetermined minimum contact force acts on the slider shoe irrespective of the load.

The problem underlying the invention is to ensure that the slider shoes lie on the slanting plate.

This problem is solved in a hydraulic axial piston machine of the kind mentioned at the outset in that the pressure plate acts only on a part of the slider shoes lying, in the radial direction of the slanting plate, outside a predetermined region.

This construction enables the pressure plate to act only or at least mainly on the region of the slider shoes that tries to lift away from the slanting plate as a result of the said forces. The point of engagement of the slanting plate on the slider shoes is therefore shifted radially further outwards. Although in that case a part of each slider shoe is not acted on by the pressure plate, namely, that part of the slider shoe which is located within the predetermined region, the slider shoes are normally so rigid that it is sufficient to hold them firm at the point at which their tendency to lift away from the slanting plate is greatest. Because the point of engagement is shifted further outwards, forces much greater than before are now required to lift the slider shoes.

In a preferred construction, the predetermined region has an at least approximately circular form. This facilitates manufacture of the machine quite considerably. In addition, the control behaviour can be better predicted and thus better determined.

Advantageously, a radially outer boundary of the region runs in a corridor of predetermined radial extent, in which lie also the midpoints of openings in the pressure plate through which the slider shoes and/or the piston ends pass. In conventionally known manner the pressure plate has bores or openings through which the slider shoes are guided by means of an extension or, in rare cases, the piston ends are guided by means of their ball extension. The point of engagement of the pressure plate has now been shifted so far outwards that it does not start until radially beyond an imaginary line which runs through the midpoints of all openings of the pressure plate, or at least in the vicinity of this line. This ensures that on the one hand tilting of the slider shoes about their radially innermost edge is prevented, and on the other hand tilting about the radially outermost edge is also prevented. Tilting about the latter edge could occur if the contact force applied by the pressure plate acts on the slider shoes too far radially outwards.

It is here preferable for the radially outer boundary to be a distance from the midpoints of the openings that is less than 22% of the diameter of the openings. The limit of the region therefore lies in relatively close proximity to the imaginary line through the midpoints of the openings. The exact position of the region limit depends, however, on the operating conditions of the machine, for example on the speed, because the centrifugal force is dependent thereon, on the pressures, in particular the suction pressures, because the suction forces acting on the piston are dependent thereon, and on the gradient of the slanting plate, because inter alia the acceleration of the piston is dependent thereon and consequently the acceleration forces acting on the piston.

It is also preferable for the predetermined region to be formed by a recess in the side of the pressure plate facing towards the slanting plate. Such a recess is easy to make and ensures with a relatively high degree of reliability that no contact between pressure plate and slider shoe will take place and consequently also no introduction of force from the pressure plate onto the slider shoes will be effected. "Contact" means, of course, only the face-to-face contact approximately parallel to the plane of the slanting plate. Contact between a circumferential face of the slider shoes and the inner wall of the openings in the pressure plate can, of course, also take place in the region of the recess. Introduction of force onto the slider shoes, which is oriented substantially perpendicularly to the plane of the slanting plate, is effected only beyond the recess, that is, beyond the predetermined region.

The recess preferably has a depth in the region from about 1/10 mm to about 3/10 mm. The lower limit is determined in that, despite the distortion of the pressure plate that will occur, it is desirable to ensure a minimum distance between the pressure plate and the slider shoes in order to avoid an introduction of force into the radially inner region. The outer limit is determined by how much can be removed from the contact plate without this being appreciably weakened. If too much is removed, that is, if the recess is made too deep, then distortion of the pressure plate will increase.

It is also preferable for the recess not to exceed a depth of about 5% of the thickness of the pressure plate. This ensures that the bending characteristic of the pressure plate is not appreciably altered.

Figure 4:
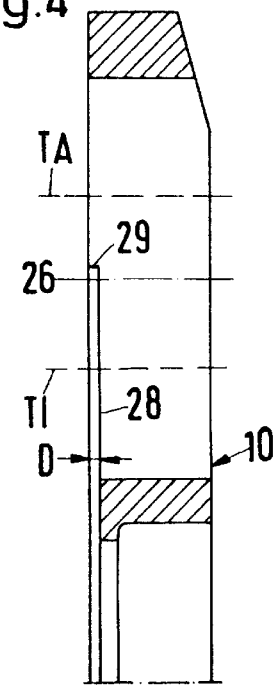
Figure 3:
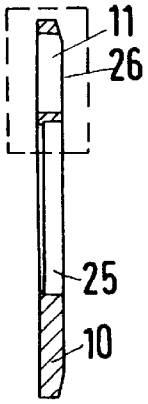
Figure 2:
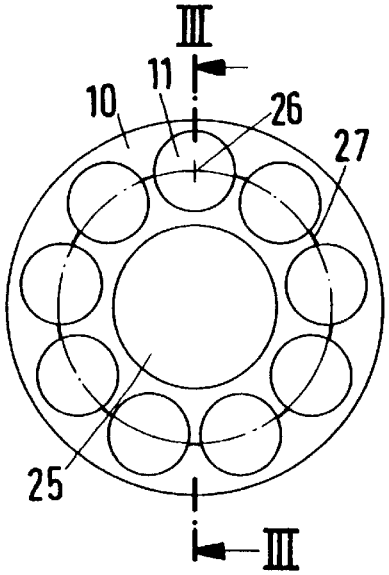
Figure 5:
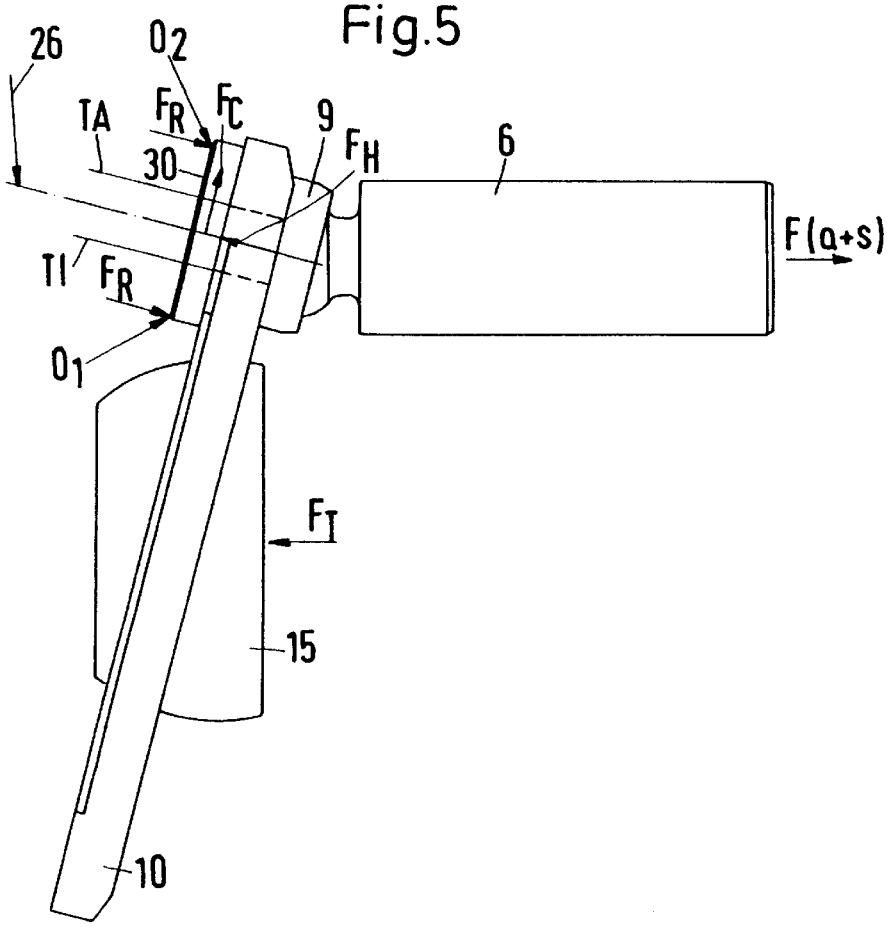

The invention is explained hereinafter with reference to a preferred embodiment in conjunction with the drawings, in which FIG. 1 is a fragmentary view of an axial piston machine with a pressure plate, FIG. 2 shows a plan view of a pressure plate, FIG. 3 is a section III—III according to FIG. 2, FIG. 4 is an enlarged fragmentary view from FIG. 3 and FIG. 5 is a diagrammatic illustration of forces acting in the region of the pressure plate.

A hydraulic axial piston machine 1, only a fragmentary view of which is shown, has a cylinder body 2 in which there are arranged several cylinders 3 (only one is illustrated), the axes of which run parallel to an axis 22 about which the cylinder body 2 rotates in the housing 12.

Each cylinder 3 has a bushing 5. A piston 6 is arranged so as to be axially displaceable in the bushing 5. The control of movement of the piston 6 is effected by way of a slanting plate 7, which is arranged fixedly in the housing 12 and against which the piston 6 bears through a ball-and-socket joint 8 by means of a slider shoe 9. The slider shoe 9 is held by means of a pressure plate 10 against the slanting plate 7. The pressure plate 10 lies against a shoulder 23 of the slider shoe 9 which extends approximately parallel to the slanting plate 7. An extension 24 of the slider shoe 9 passes through an opening 11 in the pressure plate 10. This extension 24 also mounts the ball-and-socket joint 8.

Whenever the cylinder body 2 performs a full revolution, the piston 6 is moved once back and forth. By changing the inclination of the slanting plate 7 the stroke volume of the piston 6 can be changed. Of course, the cylinder body 2 can alternatively be fixed in the housing 12, if the slanting plate 7 rotates.

The pressure plate 10 is linked by way of a further ball-and-socket joint 13 to the cylinder body 2. The pressure acting on the pressure plate 10, which pressure holds the slider shoes 9 against the slanting plate 7, can be generated, for example, by means of a spring, not shown. A piston-cylinder unit which generates the necessary contact pressure is also possible.

The ball-and-socket joint 13 is arranged on an axial extension 14 of the cylinder body 2. It consists of an annular complementary component 15 having a spherically convex surface 16 pushed onto the extension 14, and which in other words forms part of a surface of a sphere. At its end remote from the slanting plate 7, the complementary component 15 has a cylindrical region 17 of reduced diameter compared with the spherical surface 16. This region 17 serves, for example, to hold the complementary component 15 fixed during manufacture.

A bearing element 18, which surrounds the complementary component 15 annularly and has a spherical bearing surface 19 matched to the spherical form of the complementary component 15, works together with the complementary component 15. The bearing element 18 is formed from a plastics material which is able to slide with low friction on the material of the complementary component 15, even if no lubrication is provided there. The bearing element 18 is surrounded annularly by the pressure plate 10. The pressure plate has two bearing surfaces 20, 21, which run substantially parallel to its facial surface. The bearing element 18 has corresponding bearing surfaces with which it lies against the pressure plate 10. Alternatively, the pressure plate 10 can rest directly on the complementary component 15 if it has a suitably spherically constructed bearing surface.

If the complementary component 15 is now loaded by a force in the direction towards the slanting plate 7, the force is transferred to the pressure plate 10. This in turn presses the slider shoes 9 against the slanting plate 7.

FIG. 2 shows a plan view of the pressure plate 10 having in its middle an opening 25 which serves to receive the bearing element 18 and the complementary component 15. The openings 11 which serve to receive the slider shoes 9 are also visible. Each opening 11 has a midpoint 26. All midpoints are arranged on a common circle 27.

The pressure plate 10 is illustrated in FIG. 3 in the section III—III from FIG. 2. FIG. 4 is an enlarged fragmentary view from FIG. 3. In this enlargement one can see that the side of the pressure plate 10 facing towards the slanting plate 7 is provided with a recess 28. The recess 28 has a depth D which is in the range from about 1/10 mm to 3/10 mm. The depth D of the recess 28 should not exceed 5% of the thickness of the pressure plate 10.

The recess 28 has a substantially circular form. It has a radial extent that reaches to about the circle 27 on which the midpoints 26 of the openings 11 lie. The radial extent of the recess 28 may be larger or smaller than the radius of the circle 27, but the tolerance range or corridor, in which a radial boundary 29 of the recess 28 lies, extends outwards and inwards from the circle 27 by an amount that is less than 22% of the diameter of the openings 11. The limits of this tolerance range are marked in FIG. 4 with TA and TI. In other words, TA and TI are each a distance from the midpoint line 27 which is smaller than 22% of the diameter of an opening 11. The width of the region defined by TA and TI is less than 44% of the diameter of the opening 11. The radial boundary 29 of the recess 28 can be located within the region bounded by TA and TI. The exact position of the radial boundary 29 is dependent on a number of influencing factors, in particular on the intended use and the operating parameters of the machine. These operating parameters are, for example, the speed of the cylinder body 2, the inclination of the slanting plate 7 and the pressures occurring in the cylinders 3.

This will be explained in greater detail with reference to FIG. 5. A force $F_\tau$ is introduced by means of the complementary component 15 onto the pressure plate 10.

It is possible that this force $F_\tau$ may result in slight bending of the pressure plate 10. It is then no longer the same distance all over from the slanting plate 7. On the contrary, the distance in the middle is less than at the outer periphery.

The centrifugal force $F_C$, which attempts to move the slider shoes 9 outwards, and a force $F_{(a+s)}$ produced by the piston 6, which consists of an acceleration force $F_a$ of the piston and a force $F_5$ produced by the suction forces, act on the slider shoes. The bearing forces $F_R$ from the slanting plate 7 also act on the slider shoe 9. These forces have to be compensated for by the pressure force $F_H$ of the pressure plate 10, to ensure that the running surface 30 of the slider shoe 9 is always guided parallel to the slanting plate 7.

Provided that the pressure plate 10 is parallel to the slanting plate 7, it also lies in face-to-face contact with the shoulder 23 of the slider shoe 9. In this theoretically imaginary and ideal case, the introduction of force is effected absolutely evenly and symmetrically, so that the resulting point of application of the force is located in the middle of the slider shoe 9. If, however, the pressure plate 10 bends, this point of application of the force migrates radially further inwards. In that case the radially inward part of the slider shoe is stressed more heavily than the radially outer part. The directional components are in this particular case related to the slanting plate 7. In this instance, under certain operating conditions it may happen that the slider shoe 9 tilts about a pivot point 01, that is, lifts away from the slanting plate at its radially outer side. This results in increased wear at the radially inner side of the slider shoe 9. Apart from that, hydrostatic deloading can no longer be guaranteed because the hydraulic fluid is able to escape through the relatively large gap lying radially further to the outside.

If the bearing surface of the pressure plate 10 on the shoulder 23 of the slider shoe 9 is restricted to a region lying radially further to the outside, however, this phenomenon is counteracted. The slider shoe 9 is in practice held securely where it shows a tendency to lift. Even if the pressure plate 10 bends, the point of application of the force on the slider shoe is displaced only so far radially inwards that lifting or tilting of the slider shoe need not be feared. On the other hand, because the radial boundary 29 of the recess 28 is located in the corridor formed by the limits TI and TA, the radial boundary 29 is also prevented from being shifted too far outwards. In that case, the slider shoe 9 could in fact tilt about the pivot point 02, which would be equally undesirable. Since, however, the radial boundary 29 is always arranged close to the midpoint line 27, the desired equilibrium can always be achieved relatively easily.

The depth D of the recess 28 is selected in accordance with the fact that, on the one hand, there must be a certain minimum depth present to achieve the desired effect. On the other hand, it would be undesirable to remove too much material as that would weaken the pressure plate 10 too much.

We claim:

1. A hydraulic axial piston machine having axially movable pistons, said pistons having slider shoes at one end bearing against a slanting plate, and having a pressure plate for holding the slider shoes in contact with the slanting plate, the pressure plate having an unmounted outer periphery and being formed with a contact surface bearing in a planar fashion on a part of the slider shoes lying, in the radial direction of the slanting plate, outside a predetermined region formed in the pressure plate.

2. A machine according to claim 1 in which the predetermined region has a substantially circular form.

3. A machine according to claim 1, in which the predetermined region has a radially outer boundary which extends a predetermined radial extent, the pressure plate having openings through which the slider shoes and the piston ends respectively pass, the openings having midpoints lying within said outer boundary.

4. A machine according to claim 3, in which the radially outer boundary is a distance from the midpoints of the openings that is less than 22% of the diameter of the openings.

5. A machine according to claim 1, in which the predetermined region comprises a recess in a side of the pressure plate facing the slanting plate.

6. A machine according to claim 5, in which the recess has a depth from about 1/10 mm to about 3/10 mm.

7. A machine according to claim 5, in which the recess does not exceed a depth of about 5% of the thickness of the pressure plate.

8. A machine according to claim 2, in which the predetermined region has a radially outer boundary which extends a predetermined radial extent, the pressure plate having openings through which the slider shoes and the piston ends respectively pass, the openings having midpoints lying within said outer boundary.

9. A machine according to claim 8, in which the radially outer boundary is a distance from the midpoints of the openings that is less than 22% of the diameter of the openings.

10. A machine according to claim 2, in which the predetermined region comprises a recess in a side of the pressure plate facing the slanting plate.

11. A machine according to claim 10, in which the recess has a depth from about 1/10 mm to about 3/10 mm.

12. A machine according to claim 6, in which the recess does not exceed a depth of about 5% of the thickness of the pressure plate.

* * * * *